US007909211B2

(12) United States Patent
Springhorn

(10) Patent No.: US 7,909,211 B2
(45) **Date of Patent: *Mar. 22, 2011**

(54) DISPENSING CARTRIDGE WITH VENTED PISTON

(75) Inventor: Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/621,895

(22) Filed: Nov. 19, 2009

(65) Prior Publication Data

US 2010/0065127 A1 Mar. 18, 2010

Related U.S. Application Data

(63) Continuation of application No. 11/223,282, filed on Sep. 9, 2005, now Pat. No. 7,621,428.

(60) Provisional application No. 60/696,154, filed on Jul. 1, 2005.

(51) Int. Cl.
*B67D 7/60* (2010.01)

(52) U.S. Cl. ..... 222/387; 222/1; 222/326; 222/386

(58) Field of Classification Search ..... 222/386, 222/387, 1, 326–327; 604/236–238, 121–122; 215/11.5, 248; 220/361, 366.1, 227, 580, 220/203.05, 203.06, 203.13, 303, 374; 137/1
See application file for complete search history.

(56) References Cited

U.S. PATENT DOCUMENTS

| | | | | |
|---|---|---|---|---|
| 4,299,238 | A | 11/1981 | Baidwan et al. | |
| 4,373,535 | A | 2/1983 | Martell | |
| 4,452,370 | A | 6/1984 | Langensiepen et al. | |
| 4,615,341 | A | 10/1986 | Marzolf et al. | |
| 4,632,672 | A | 12/1986 | Kvitrud | |
| 4,657,028 | A | 4/1987 | Rich et al. | |
| 4,792,065 | A | 12/1988 | Soehnlein et al. | |
| 4,819,836 | A | 4/1989 | Meckenstock | |
| 4,951,848 | A | 8/1990 | Keller | |
| 5,150,823 | A | 9/1992 | Sugita | |
| 5,178,305 | A | 1/1993 | Keller | |
| 5,400,926 | A | 3/1995 | Keller | |
| 5,865,803 | A | 2/1999 | Major | |
| 6,494,348 | B2 | 12/2002 | Prestele | |
| 6,598,766 | B1 | 7/2003 | Brugner | |
| 6,685,063 | B2 | 2/2004 | Brugner | |
| 6,899,254 | B1 | 5/2005 | Sandholm et al. | |
| 7,621,428 | B2 * | 11/2009 | Springhorn | 222/387 |
| 2005/0029306 | A1 | 2/2005 | Brennan | |

FOREIGN PATENT DOCUMENTS

EP 0081145 A1 6/1983

(Continued)

OTHER PUBLICATIONS

European Patent Office; Search Report in European Patent Application No. 06394003 dated Apr. 7, 2006; 8 pages.

*Primary Examiner* — Frederick C. Nicolas
(74) *Attorney, Agent, or Firm* — Wood, Herron & Evans, L.L.P.

(57) ABSTRACT

A dispensing cartridge with a vented piston is disclosed. The piston includes a piston shell and a bleed plug. The arrangement of the piston shell and the bleed plug allows air to be vented through the piston until all of the air is vented out of the dispensing cartridge. With the air vented out of the dispensing cartridge, the piston self-into actuates into a closed sealed position in which the bleed plug forms a seal with the piston shell to prevent further fluid from flowing between the two elements.

11 Claims, 7 Drawing Sheets

FOREIGN PATENT DOCUMENTS

| | | | |
|---|---|---|---|
| EP | 0463991 | A1 | 1/1992 |
| EP | 1308218 | A2 | 5/2003 |
| EP | 1514812 | A1 | 3/2005 |
| EP | 1738834 | A1 | 1/2007 |
| WO | 95/28337 | A1 | 10/1995 |
| WO | 01/55006 | A1 | 8/2001 |
| WO | 03/050012 | A1 | 6/2003 |

* cited by examiner

DISPENSING CARTRIDGE WITH VENTED PISTON

CROSS-REFERENCE TO RELATED APPLICATIONS

This Application is a continuation of U.S. patent application Ser. No. 11/223,282 (pending), filed Sep. 9, 2005, which claimed priority from and claimed the benefit of U.S. Provisional Application Ser. No. 60/696,154 (expired), filed Jul. 1, 2005, the disclosures of which are incorporated by reference herein in their entirety.

BACKGROUND

Pistons have been used for years in dispensing cartridges to dispense liquids from the cartridge. The issue has always been, especially with liquids that need to be dispensed at very precise ratios, how to keep air from getting trapped between the piston and the liquid in the cartridge when the piston is inserted into the cartridge during filling. In the very near past, pistons have been developed with integral bleed or ventilation outlets which allow the air to vent to atmosphere without the use of bleed shims or other means to separate the portion of the piston that forms a seal with the cartridge wall from the cartridge wall. These pistons formed with integral bleed or ventilation outlets have been very effective at increasing the efficiency with which air is evacuated from the dispensing cartridge and at decreasing the damage done to piston seals by bleed shims.

While pistons formed with integral bleed or ventilation outlets have been an improvement, significant drawbacks still remain. Such pistons require some separate or specialized device or mechanism to either keep the vent open during the filling process or to close the vent after a cartridge has been filled. None of the prior pistons automatically close during the filling process. None of the prior pistons are self-actuating.

Also, the design of some prior ventilating piston assemblies cause air to be trapped in the piston after the cartridge is sealed. Such trapped air is undesirable. The piston disclosed in U.S. Pat. No. 6,598,766 is an example of such a piston having the undesirable effect of trapping air in the piston after air has been evacuated from the dispensing cylinder.

Accordingly, there is a need for an improved piston for use in a dispensing cartridge.

SUMMARY

According to one aspect of the present invention, a piston includes a piston shell having an opening to atmosphere formed therein and a bleed plug having at least one bleed channel formed thereon. According to this aspect of the present invention, the bleed plug is disposed within the piston shell and is designed such that at a pre-determined pressure point the bleed plug moves into sealing engagement with the piston shell to form a seal. The bleed plug may have a sealing edge formed thereon, and the sealing edge, according to this aspect of the present invention, moves into sealing engagement with the piston shell to form a seal at the pre-determined pressure point. The piston shell further may have a seal surface formed therein with at least one notch formed on it, in which the sealing edge moves into sealing engagement with the seal surface of the piston shell to form a seal at the pre-determined pressure point.

According to another aspect of the present invention, the at least one bleed channel formed on the bleed plug is formed as two spiral channels. The bleed plug may further have a connecting structure formed thereon, such that, at the pre-determined pressure point, the connecting structure engages the opening to atmosphere formed in the piston shell. The connecting structure may have an opening formed therein and the connecting structure may be formed as a half-split, cylinder structure.

According to other aspects of the invention, the piston described above is utilized in a dispensing cartridge and in a method for venting air from a dispensing cartridge.

DESCRIPTION OF THE DRAWINGS

These and other features, aspects and advantages of the present invention will become better understood with regard to the following description, appended claims and accompanying drawings where:

DETAILED DESCRIPTION

Figure 1A:
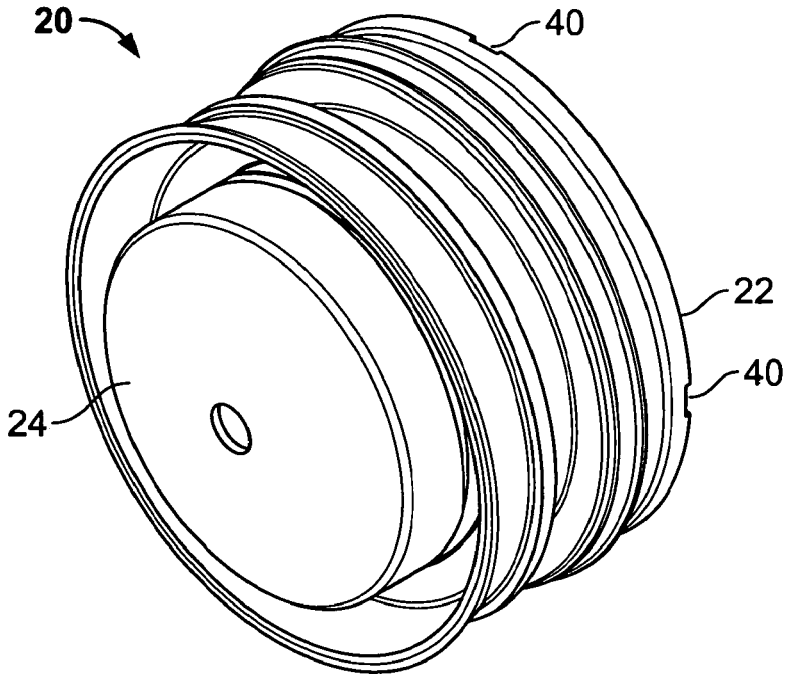
FIG. 1A is a perspective view of an embodiment of a piston of the present invention from the liquid facing side.
Figure 2:
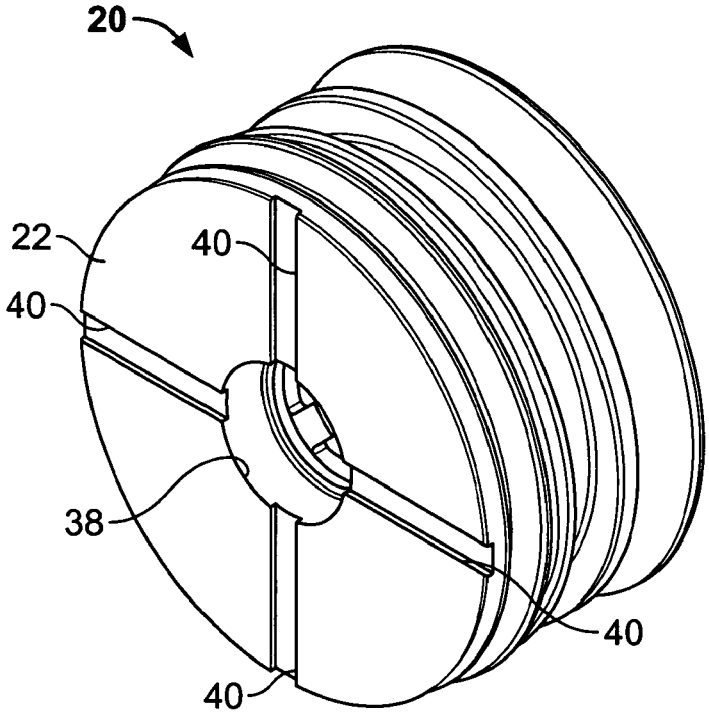
FIG. 2 is a perspective view of the piston depicted in FIG. 1A from the side of the piston that faces atmosphere.
Figure 1B:
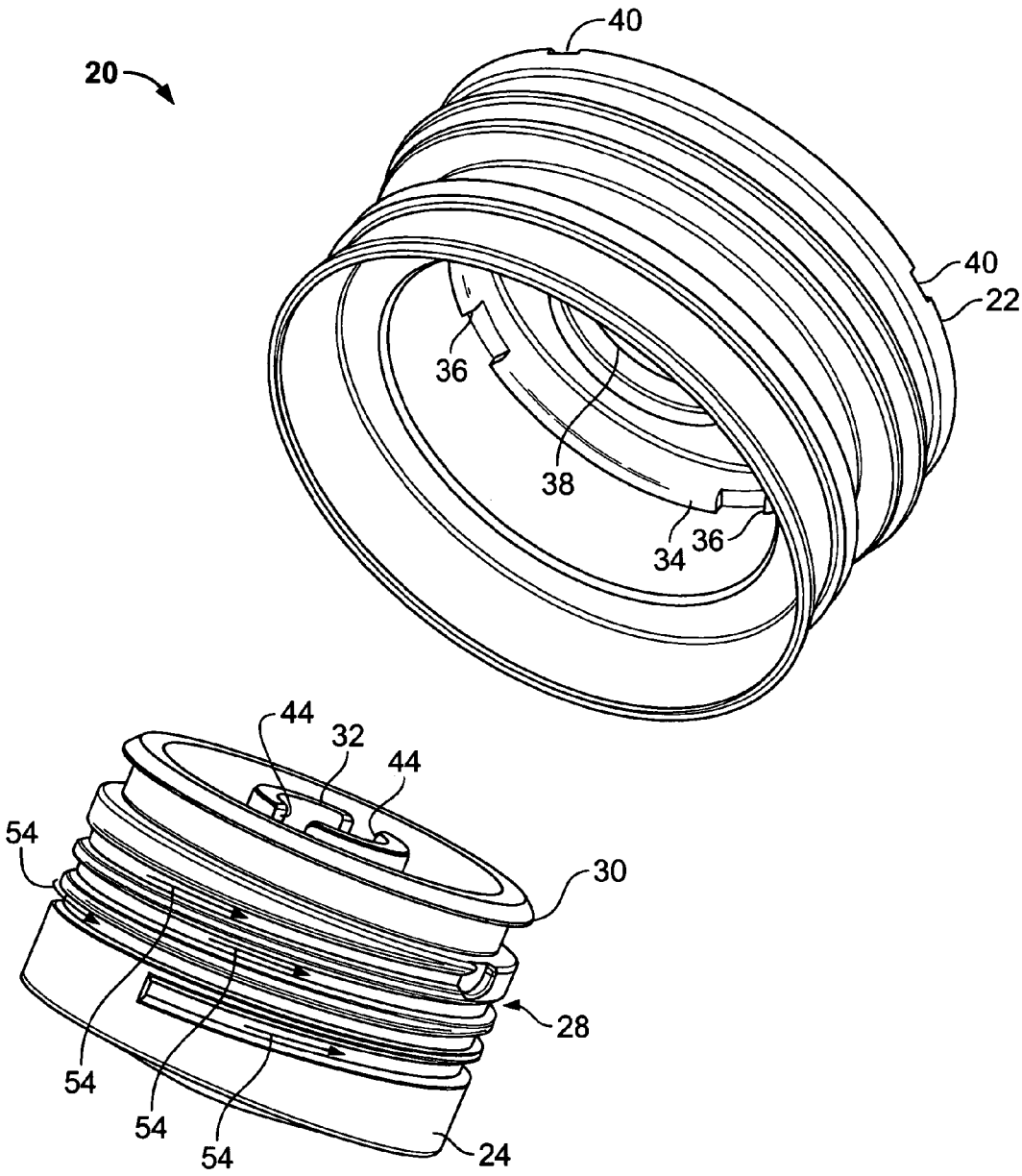
FIG. 1B is an exploded view of the piston depicted in FIG. 1A.

Referring to FIGS. 1A, 1B and 2, an embodiment of a piston 20 of the present invention is depicted. As best seen in FIG. 1B, the piston 20 in this embodiment has two components: a piston shell 22 and a bleed plug 24. The two components 22, 24 of the piston 20 are made from a dimensionally stable and chemically inert material, such as thermoplastic or thermoset material in this embodiment. As depicted in FIG. 1A, in an assembled configuration prior to being inserted into a cylinder 26 of a dispensing cartridge 27 (FIG. 3A), the bleed plug 24 seats in the piston shell 22 in an open non-sealed, first position.

The bleed plug 24 has a bleed channel 28 formed therein. In this embodiment, the bleed channel 28 is formed as two spiral bleed channels formed on the exterior of the bleed plug 24. The bleed channels 28 may be formed in any manner that allows air to pass between the bleed plug 24 and the piston shell 22, while simultaneously preventing any liquid from attempting to pass through, when the bleed plug 24 is in the non-sealed, open position. The bleed plug 24, in this embodiment, has a sealing edge 30 formed on the upper edge of the bleed plug 24. The bleed plug 24, in this embodiment, also has a connecting structure 32 with at least one opening 44 formed in the interior of the bleed plug 24. In this embodiment, the connecting structure 32 is formed as a half-split, cylinder structure formed in the center of the interior of the bleed plug 24. The connecting structure 32 in this embodiment has two openings 44 formed by the half-split in the cylinder structure.

In other embodiments, other forms of connecting mechanisms, other than the connecting structure 32 discussed above, could be utilized. It is contemplated that other embodiments of the piston 20 would not incorporate a connecting structure at all. An example of such an embodiment would be one that utilizes an interference fit between the piston shell 22 and the bleed plug 24 to secure the piston shell 22 and the bleed plug 24 together in a closed, seal position.

As best seen in FIG. 1B, the piston shell 22 has a thickened seal surface 34 formed integral to the interior of the piston shell 22. The thickened seal surface 34 acts to reduce the inner diameter of the piston shell 22 at that point. The seal surface 34 has air passage notches 36 formed at various points along the circumference of the seal surface 34. In the embodiment depicted, four notches 36 are formed in the seal surface 34. Two notches 36 are visible in the view depicted in FIG. 1B. The seal surface 34 in this embodiment also has a chamfered edge. As explained in detail below, the notches 36 formed in the seal surface 34 facilitate air passing through the piston 20 when the bleed plug 24 is in the open, non-sealed position. When the bleed plug 24 is moved into a closed, second position, the sealing edge 30 of the bleed plug 24 engages the seal surface 34 in an interference fit, forming a seal which stops air from flowing between the bleed plug 24 and the piston shell 22.

In this embodiment, the piston shell 22 has a central opening 38, best seen in FIG. 2, formed in the center of the back portion of the piston shell 22. The piston shell 22 also has vent grooves 40 formed along the back of the piston shell 22, which are in communication with the central opening 38. A piston 22 is typically inserted into a dispensing cylinder 26 with a piston insertion rod. The vent grooves 40 function to allow air venting out from the piston interior to flow out from beneath and past the piston insertion rod when the piston 22 is being inserted into a cylinder 26.

Figure 3A:
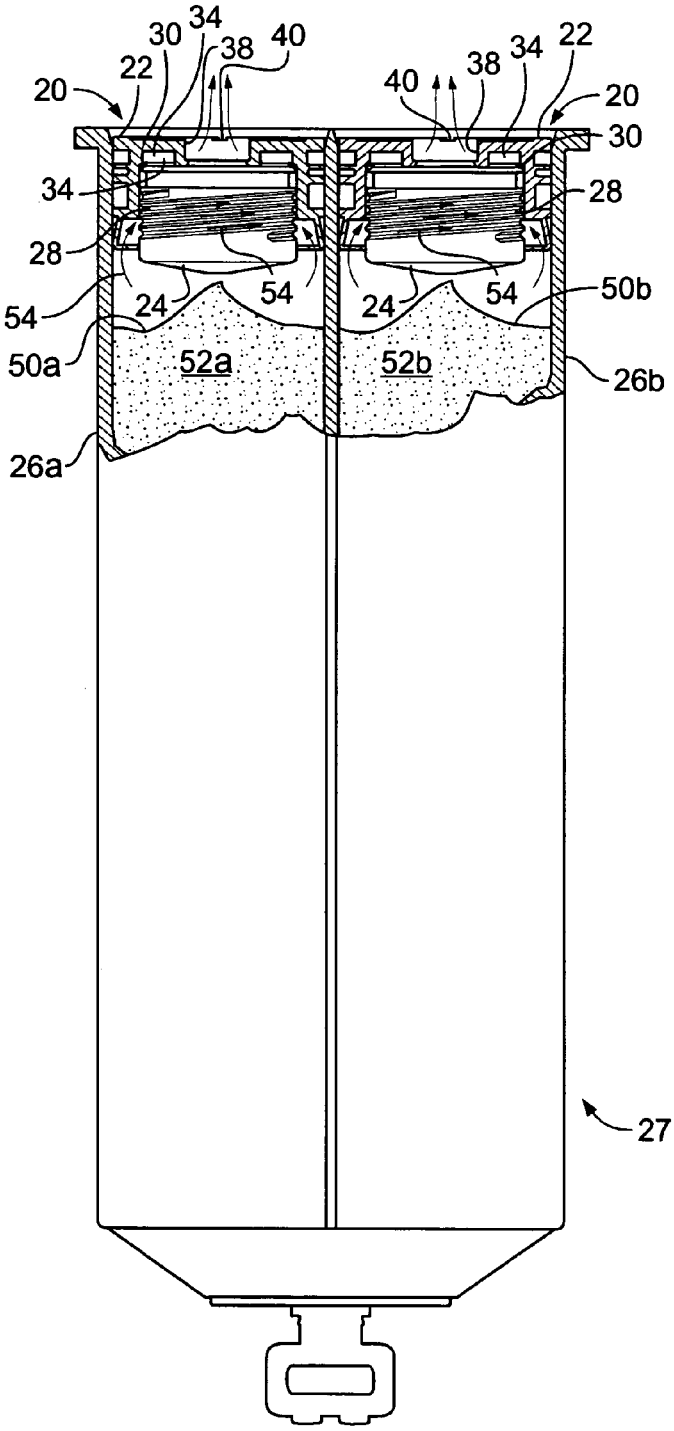
FIG. 3A illustrates a piston of the present in an open position inserted into a dispensing cylinder.
Figure 3B:
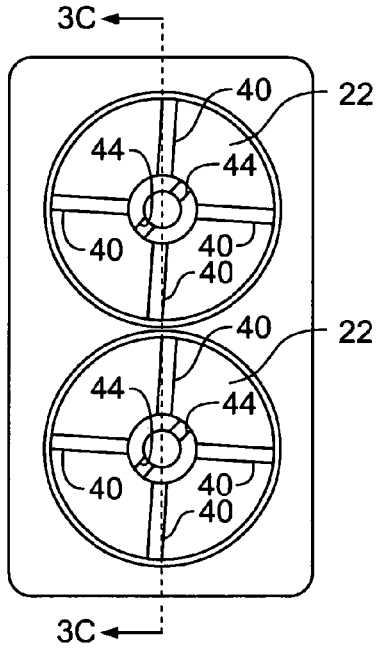
FIG. 3B is a top view of a dispensing cartridge of the present invention.
Figure 3C:
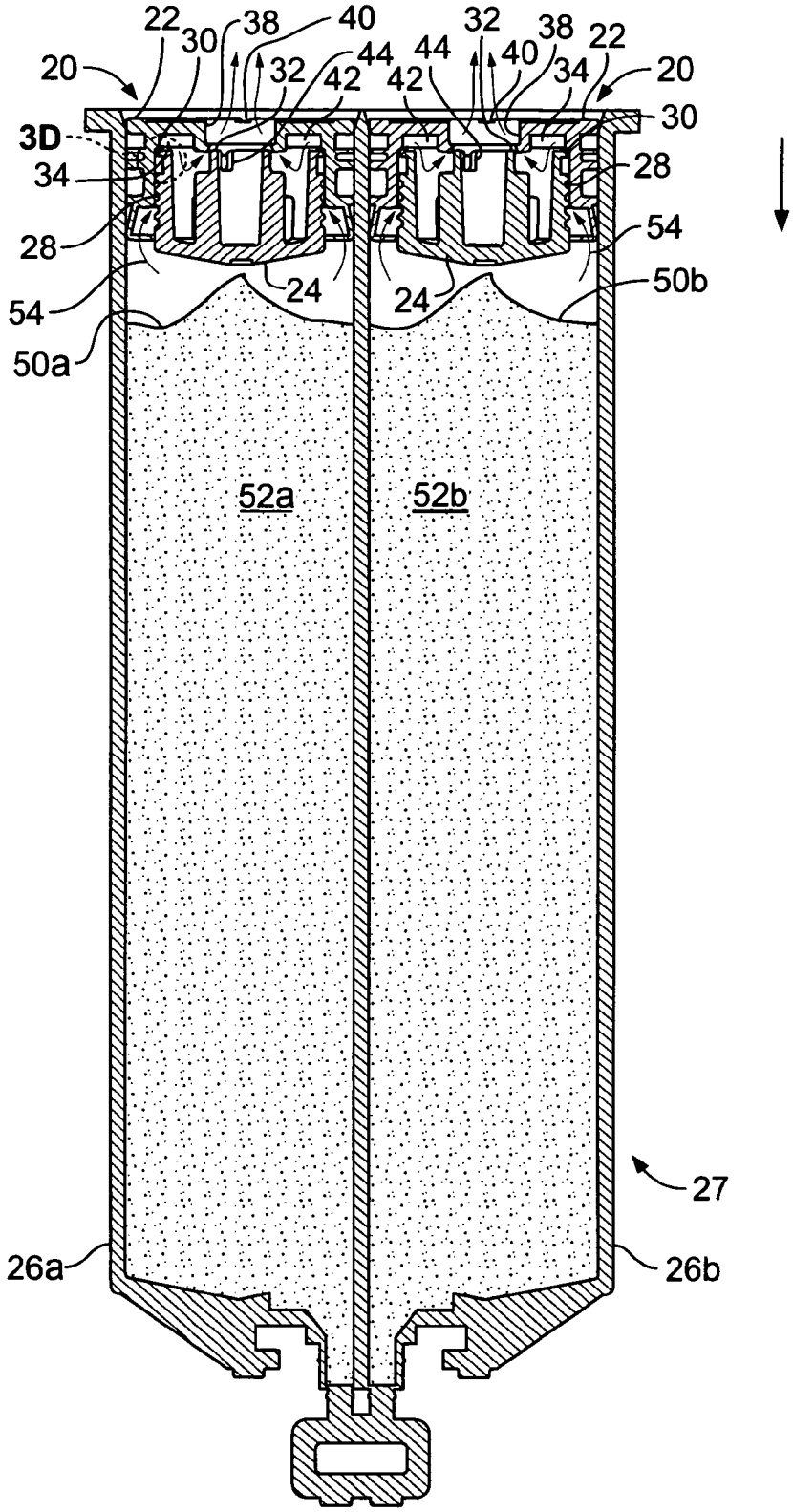
FIG. 3C is a longitudinal cross-sectional view taken along the line 3C-3C in FIG. 3B.

Referring to FIGS. 3A-3D, 4 and 5A-5B, the process of inserting assembled pistons 20 into filled dispensing cartridge cylinders 26, evacuating the air from the cylinders 26 and causing the pistons 20 to self-actuate to a closed, sealed position is depicted. FIGS. 3A-3C show pistons 20 inserted into the open ends of two filled cylinders 26*a*, 26*b*. In the initial position depicted in FIGS. 3A-3C, there is a space formed between each piston 20 and the top surface 50*a*, 50*b* of each liquid 52*a*, 52*b*. It should be understood that even though the embodiment illustrated herein describes a dual cylinder system, the piston 20 of the present invention can be used with any cylinder 26 configuration (e.g., single cylinder, dual cylinder, etc.). A wide variety of liquids, having a very wide range of viscosities, may be used with the dispensing cartridge 27 and the piston 20 of the present invention. The liquids 52*a*, 52*b* depicted in the embodiment shown in the figures are relatively highly viscous liquids, such as the components of a caulking compound. Such high viscosity liquids create irregular static liquid surface profiles along the top surfaces 50*a*, 50*b* of the liquids 52*a*, 52*b*, as can be seen in FIGS. 3A and 3C. In the embodiment depicted in the FIGS. 3A-3C, the liquids 52*a*, 52*b* in the cylinders 26*a*, 26*b* form a "Hershey kiss"-type surface profile due to the liquids' high viscosities. It should be noted that low viscosity liquids may also be used in the dispensing cartridge 27 of the present invention as well. The static liquid surface profile for such low viscosity liquids will generally be flat, as opposed to an irregular profile that a highly viscous material generates.

Figure 3D:
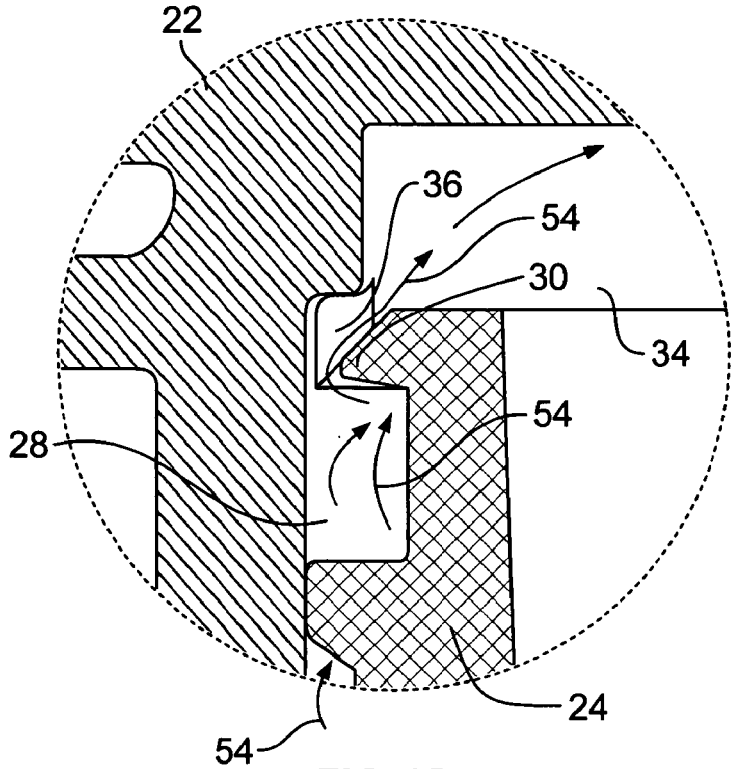
FIG. 3D is an enlarged view illustrating the interaction of the bleed plug and the piston shell in an open position.

To evacuate the air from the space formed between the pistons 20 and the liquids 52*a*, 52*b*, the pistons 20 are pressed into the cylinders 26*a*, 26*b* in the direction indicated by the arrow in FIG. 3C. As the pistons 20 are pressed into the cylinders 26*a*, 26*b*, the air trapped between each piston 20 and their respective liquid 52*a*, 52*b* is pushed through the piston 20 and out to atmosphere. Referring to FIGS. 3C and 3D, the flow path of the exiting air is indicated by arrows 54. The air trapped between a piston 20 and a liquid 52 hits the bottom of the bleed plug 24 and spreads to the outer edge of the bleed plug 24 where it is forced, in this embodiment, into the two spiral bleed channels 28 formed along the exterior of the bleed plug 24. From the two spiral bleed channels 28, the air flows around the sealing edge 30 of the bleed plug 24 and, depending on the position of the sealing edge 30 in relation to the seal surface 34, through the notches 36 formed in the seal surface 34 of the piston shell 22. From the notches 36, the air continues to flow into and through an annular chamber 42 formed between the bleed plug 24 and the piston shell 22. From the annular chamber 42, in this embodiment, the air passes through the openings 44 formed in the connecting structure 32 and then out of the piston 20 to atmosphere through the opening 38. In other embodiments, the piston 20 may be formed such that air being evacuated from the piston 20 passes straight from the notches 36 out through the opening 38. As described above, if the piston 20 is being pushed in with a piston insertion rod, the air will travel from the opening 38 to and through the vent grooves 40 along the back of the piston shell 22 to vent to atmosphere.

Figure 4:
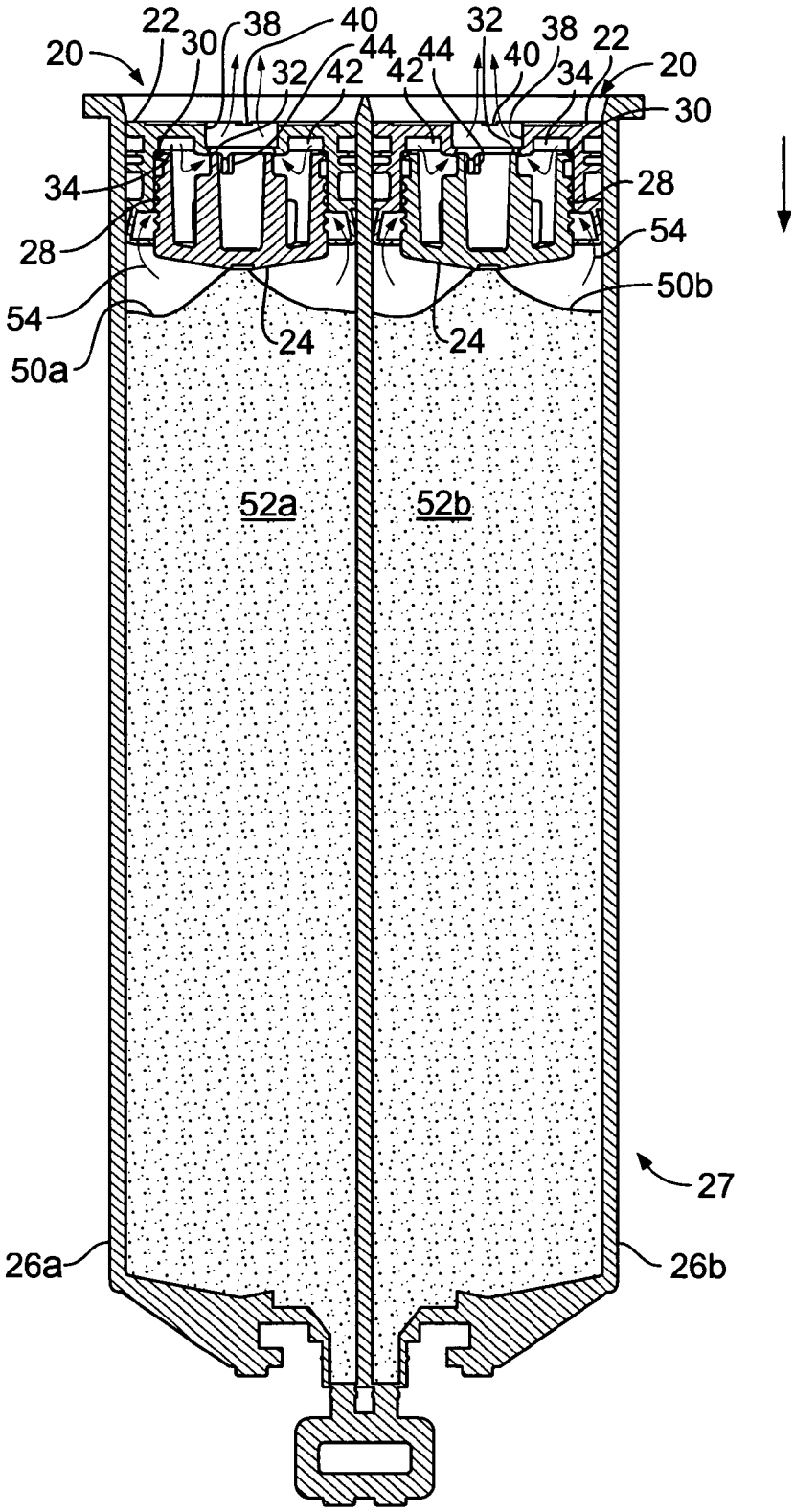
FIG. 4 is longitudinal cross-sectional view with the piston in contact with liquid in the dispensing cylinder.

As depicted in FIG. 4, as the pistons 20 are pressed further into the cylinders 26*a*, 26*b*, the air continues to flow through the pistons 20 in the manner described above, even after the bleed plugs 24 come into contact with their respective liquids 52*a*, 52*b*.

Figure 5B:
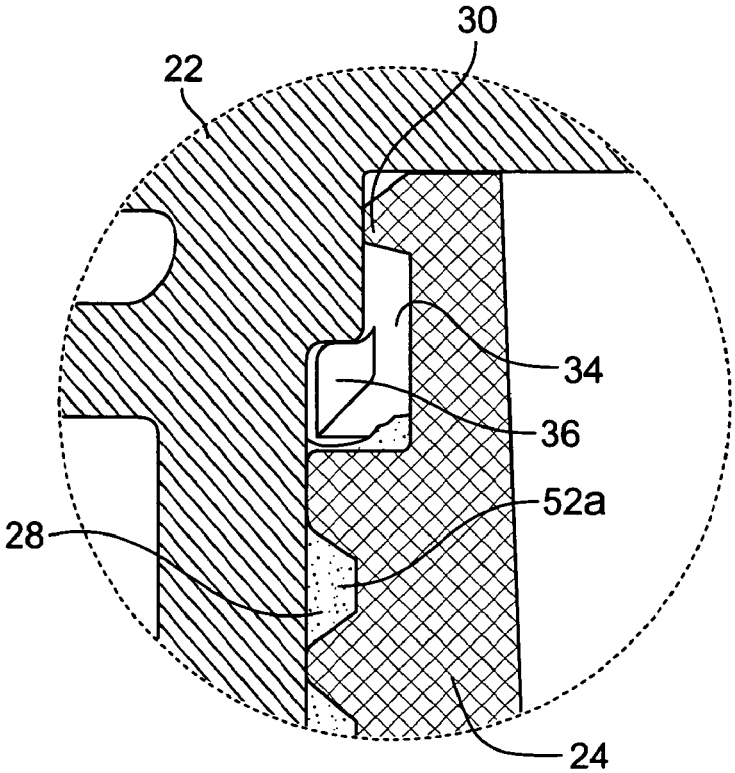
FIG. 5B is an enlarged view illustrating the interaction of the bleed plug and the piston shell in a closed position.
Figure 5A:
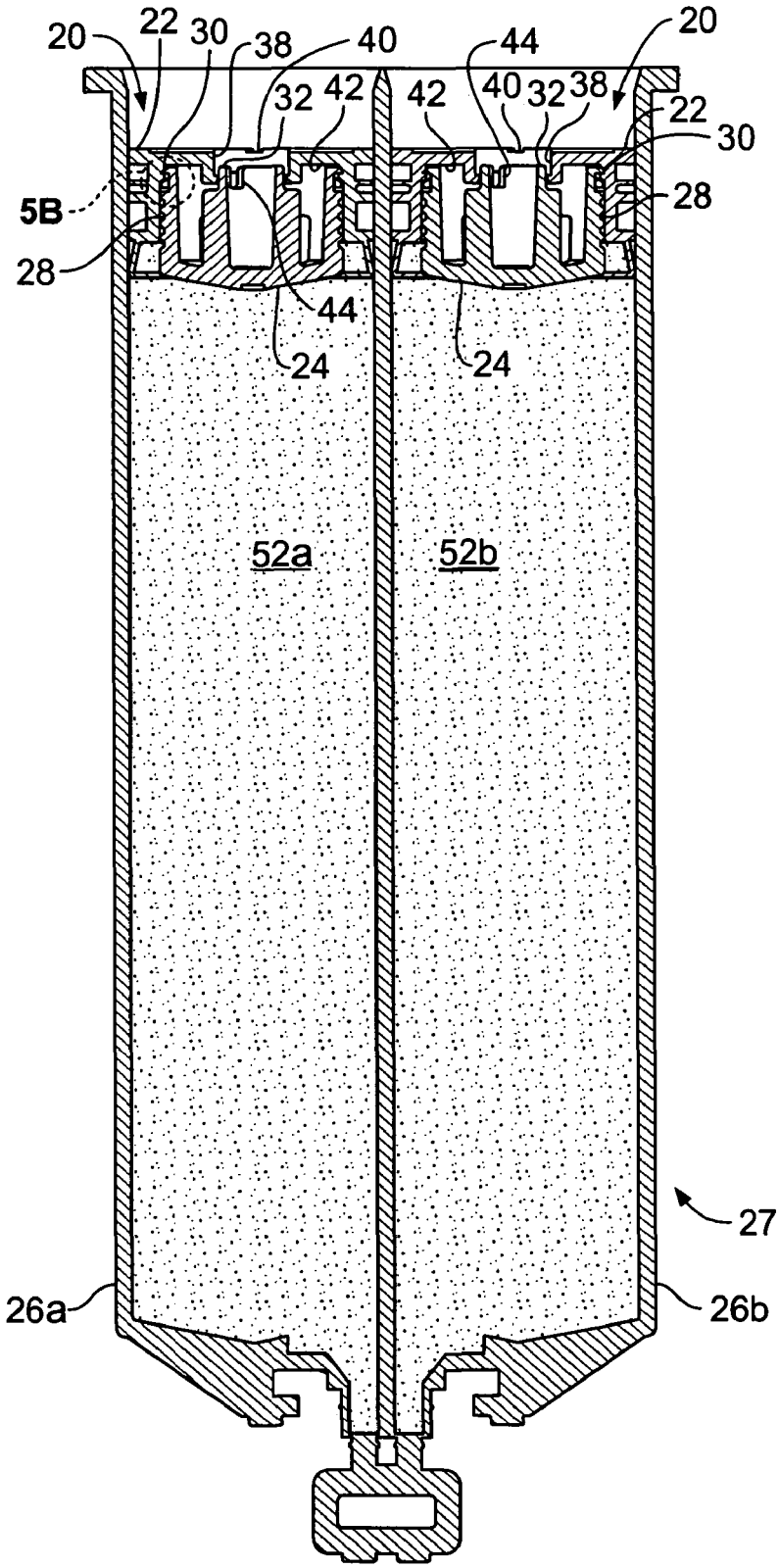
FIG. 5A is longitudinal cross-sectional view with the piston full in contact with liquid in the dispensing cylinder and the piston in a closed position.

As the pistons 20 are pressed forward, less and less air remains in the space between the piston 20 and the liquid 52 and more and more liquid 52 contacts the piston 20. As the liquids 52*a*, 52*b* press back against their respective bleed plugs 24 and start entering their respective spiral bleed channels 28, the bleed plugs 24 are pressed further into their piston shells 22. As the bleed plugs 24 are pressed further into their piston shells 22, the sealing edges 30 on the upper edge of each bleed plug 24 are pressed along each seal surface 34 to a point above the notches 36 formed in each seal surface 34 creating an interference fit, as depicted in FIGS. 5A-B. As a consequence, a seal is formed between the sealing edge 30 and the seal surface 34, such that air no longer flows around the sealing edge 30. Simultaneously, the connecting structure 32 for each piston 20 is pushed into its respective opening 38 in the piston shell 22. In this embodiment, the half-split cylinder structure of each connecting structure 32 compresses as it moves into the opening 38, and each connecting structure 32 literally snaps into place within the opening 38. At this point, air is evacuated from each cylinder 26*a*, 26*b* between the liquids 52*a*, 52*b* and their respective pistons 20, and each cylinder 26*a*, 26*b* is sealed. No air is trapped in the annular chambers 42 of the pistons 20 because the openings 44 formed in the connecting structures 32 allow air in the annular chambers 42 to vent to atmosphere through openings 38.

While the invention has been discussed in terms of certain embodiments, it should be appreciated that the invention is not so limited. The embodiments are explained herein by way of example, and there are numerous modifications, variations and other embodiments that may be employed that would still be within the scope of the present invention.

What is claimed is:

1. A piston for venting air and dispensing liquid, the piston, comprising:

a piston shell having an opening to atmosphere formed therein; and a bleed plug having at least one bleed channel formed thereon and defined by oppositely disposed sidewalls;

wherein the bleed plug is disposed within the piston shell for engagement with the liquid, and wherein the bleed plug is designed such that at a pre-determined pressure point developed by movement of the piston in contact with the liquid the bleed plug moves into sealing engagement with the piston shell to form a seal.

2. The piston of claim 1, wherein the bleed plug has a sealing edge formed thereon, and the sealing edge moves into sealing engagement with the piston shell to form a seal at the pre-determined pressure point.

3. The piston of claim 1, wherein the bleed plug has a connecting structure formed thereon, and wherein, at the pre-determined pressure point, the connecting structure interlocks with the opening to atmosphere formed in the piston shell and thereby prevents the bleed plug from moving out of sealing engagement with the piston shell.

4. The piston of claim 1, wherein the bleed channel is in fluid communication with atmosphere prior to sealing engagement of the bleed plug with the piston shell, independent of pressure applied to the piston.

5. The piston of claim 1, wherein:

the bleed plug is slidably disposed within the piston shell; and the bleed plug is responsive to the pre-determined pressure developed after the liquid contacts the bleed plug, to move from a first position wherein air can traverse the bleed channel, to a second position wherein the bleed plug contacts the piston shell to seal the bleed channel.

6. A dispensing cartridge having liquid contained therein and having a vented piston, comprising:

at least one cylinder formed in the dispensing cartridge and having liquid contained therein;

a piston disposed within and in sealing engagement with the at least one cylinder, the piston comprising: a piston shell having an opening to atmosphere formed therein; and a bleed plug having at least one bleed channel formed thereon and defined by oppositely disposed sidewalls;

wherein the bleed plug is disposed within the piston shell and wherein when the bleed plug is pressed against the liquid contained within the dispensing cartridge, the bleed plug, at a pre-determined pressure point developed by movement of the piston in contact with the liquid, is moved into sealing engagement with the piston shell to form a seal.

7. The piston of claim 6, wherein the bleed plug has a sealing edge formed thereon, and the sealing edge moves into sealing engagement with the piston shell to form a seal at the pre-determined pressure point.

8. The piston of claim 6, wherein the bleed plug has a connecting structure formed thereon, and wherein, at the pre-determined pressure point, the connecting structure engages the opening to atmosphere formed in the piston shell.

9. A method for venting air from a dispensing cartridge having liquid contained therein and having a piston disposed within the dispensing cartridge, wherein the piston is in sealing engagement with the dispensing cartridge and air is disposed between the liquid and the piston and wherein the piston includes a piston shell having an opening to atmosphere formed therein and a bleed plug having at least one bleed channel formed thereon, the method comprising:

pressing the piston towards the liquid within the dispensing cartridge, wherein the air disposed between the piston and the liquid flows between the piston shell and the bleed plug through the at least one bleed channel formed on the bleed plug and out to atmosphere through the opening to atmosphere formed in the piston shell; and continuing to press the piston towards the liquid within the dispensing cartridge until the liquid contacts the bleed plug and creates a pre-determined amount of pressure that moves the bleed plug into sealing engagement with the piston shell to form a seal.

10. The method of claim 9, wherein the bleed channel is formed along an exterior of the bleed plug, and wherein air trapped between the piston and the liquid contacts the bottom of the bleed plug and spreads to an outer edge of the bleed plug where it is forced into the bleed channel.

11. The method of claim 9, wherein the bleed plug is moved further into the piston shell as the liquid presses back against the bleed plug and starts entering the bleed channel; and as the bleed plug is moved further into the piston shell, a sealing edge on an upper edge of the bleed plug is pressed along a seal surface on the piston shell to a point above notches formed in the seal surface, thereby creating a seal between the sealing edge and the seal surface such that air no longer flows around the sealing edge.

* * * * *